US006118265A

United States Patent [19]

Larsen et al.

[11] Patent Number: 6,118,265

[45] Date of Patent: Sep. 12, 2000

[54] REFERENCE VOLTAGE STABILIZATION SYSTEM AND METHOD FOR FIXING REFERENCE VOLTAGES, INDEPENDENT OF SAMPLING RATE

[75] Inventors: Frode Larsen, Tinton Falls; Nianxiong Tan, Howell, both of N.J.

[73] Assignee: Globespan, Inc., Red Bank, N.J.

[21] Appl. No.: 09/361,801

[22] Filed: Jul. 27, 1999

Related U.S. Application Data

[60] Provisional application No. 60/098,275, Aug. 28, 1998.

[51] Int. Cl.[7] ..... G05F 3/16

[52] U.S. Cl. ..... 323/316

[58] Field of Search ..... 323/316, 317, 323/288

[56] References Cited

U.S. PATENT DOCUMENTS 5,627,486 5/1997 Gross ..... 323/316

5,734,293 3/1998 Gross ..... 323/316

5,973,487 10/1999 Henry ..... 323/316

*Primary Examiner*—Shawn Riley

*Attorney, Agent, or Firm*—Thomas, Kayden, Horstemeyer & Risley

[57] ABSTRACT

In general, the reference voltage stabilizer provides a system and method of stabilizing a reference voltage regardless of the sampling rate of a sample data system. An amplifier is utilized to amplify the reference voltage so as to maintain voltage level by stabilizing and isolating the initial reference voltage. A programmable current is utilized to modify the amplified reference voltage, thereby compensating for adjustment in current level of the reference voltage caused by system sampling. The programmable current may also be utilized to compensate for reference voltage errors occurring before amplification, by adding an intentional offset between required sink and source currents, and the current supplied by the programmable current.

23 Claims, 3 Drawing Sheets

REFERENCE VOLTAGE STABILIZATION SYSTEM AND METHOD FOR FIXING REFERENCE VOLTAGES, INDEPENDENT OF SAMPLING RATE

CROSS-REFERENCE TO RELATED APPLICATIONS

This application claims the benefit of U.S. provisional patent application Ser. No. 60/098,275, filed on Aug. 28, 1998, and entitled "Calibration of Sampling Rate Dependent Offsets," which is incorporated by reference herein in its entirety.

FIELD OF THE INVENTION

The present invention generally relates to voltage stabilization. More specifically, the invention is related to accurately maintaining the level of reference voltages, independent of the sampling frequency of the system loading the reference voltages.

BACKGROUND OF THE INVENTION

Many integrated systems require a fixed voltage, or reference voltage, with accuracy to a fraction of a percentage. With the advancement of technology, the sampling rate of sample data systems has increased, causing the number of times in which a reference voltage is used in a period of time to increase as well.

Each time a reference voltage is used, an amount of charge is removed from the reference voltage, causing the reference voltage level to decrease in value. Preferably, this decrease in voltage level is compensated for at a fast enough rate so that the reference voltage will maintain its constant level, and be stable and reasonably noise-free, before being sampled again.

Several approaches have been employed to accomplish such a constant level. One approach is not to try to settle the voltage level during the allocated sampling time, but instead. to simply use a single stage low gain amplifier with an external capacitor large enough so that the change in reference voltage, on a per sample bases, is negligible. unfortunately, this method presents no means of recharging the reference voltage to compensate for the current drawn from the reference voltages, thereby causing a DC error in the reference voltages which, in turn, causes a gain error in the sample data system.

Rather than use a large capacitor in the attempt to alleviate the dramatic effects of a reference voltage drop, other methods attempt to completely restore the reference voltage between each sampling. These methods tend to utilize very high speed, on chip amplifiers in order to settle the reference voltages between each sampling, which could potentially be less then 5 ns. While this method does keep the reference voltage constant, it also burns an enormous amount of power and requires a large amount of excess circuitry to perform the voltage settling.

Therefore, there is a need in the art for an accurate, low power approach of maintaining a reference voltage level regardless, of the sampling speed of the system upon which it is utilized.

SUMMARY OF THE INVENTION

Briefly described, the invention is a system and method for compensating for offset errors typically observed in reference voltages during the sampling of the reference voltage sources. The invention eliminates gain error caused by DC currents supplied by reference voltages as a result of sampling the reference voltages in a discrete time sample data system. This is performed by employing a combination of unity gain buffer amplifiers and programmable currents. The programmable currents provide a method of compensating for current, which has been either drawn from, or added to. the reference voltages during switching. The programmable current is determined and produced based upon, amongst other factors. the sampling rate of the system utilizing the reference voltage, thereby effectively preventing any gain error from occurring.

An alternate embodiment of the invention provides a method of compensating for errors that may have occurred in the reference voltage values, before the reference voltages were inputted to the unity gain buffer amplifiers. The present invention compensates for these errors by adding an intentional offset between required sink and source currents, and the current supplied by the programmable currents.

The invention has numerous advantages, a few of which are delineated hereafter as examples. Note that the embodiments of the invention, which are described herein, possess one or more, but not necessarily all, of the advantages set out hereafter.

One advantage of the invention is that it provides a way to prevent a reference voltage value from increasing or decreasing due to a change in the sampling rate of the system in which it is utilized.

Another advantage is that it provides a means for calibrating gain errors under digital control, independently of the source of the error, by programming an inputted current appropriately.

Another advantage is that it eliminates conventional expensive processing steps, such as blowing fuses and laser trimming, in determining parameters to compensate for gain errors.

Other objects. features, and advantages of the present invention will become apparent to one of reasonable skill in the art upon examination of the following drawings and detailed description. It is intended that all such additional objects, features, and advantages be included herein within the scope of the present invention, as defined by the claims.

BRIEF DESCRIPTION OF THE DRAWINGS

The present invention will be more fully understood from the detailed description given below and from the accompanying drawings of the preferred embodiments of the invention, which however, should not be taken to limit the invention to the specific embodiment, but are for explanation and for better understanding. Furthermore, the drawings are not necessarily to scale, emphasis instead being placed upon clearly illustrating the principles of the invention. Finally, like reference numerals in the figures designate corresponding parts throughout the several drawings.

DESCRIPTION OF THE PREFERRED EMBODIMENT

Figure 1:
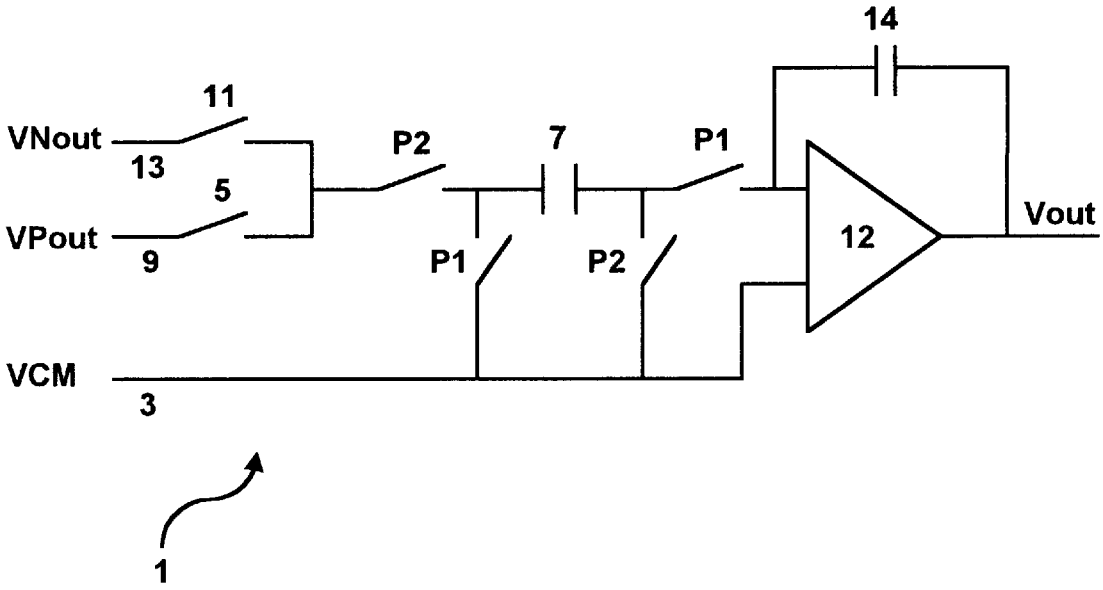
FIG. 1 is a switched capacitor integrator, being the basic building block utilized in all switched capacitor-filters, in which the present invention may be utilized.

Turning now to the drawings, wherein like reference numerals designate corresponding parts throughout the drawings, FIG. I illustrates one example of a voltage mode sample-data system, which utilizes reference voltages and depends upon reference voltage consistency. As a preliminary matter, it should be noted that the reference voltages of the present invention are described having a 3 tiered system, comprising a common mode (VCM), a high reference (VP), and a low reference voltage (VN). As an example, the values of these levels may be, but are not limited to, 2.5 volts, 3.75 volts, and 1.25 volts, respectively.

A switched capacitor integrator 1 is illustrated by FIG. 1, and is based upon distributing charge from a high (VP) or low (VN) reference voltage, into a virtual ground. A virtual ground is located across the terminals of amplifier 12 which also sit at a predefined common mode voltage (VCM), as determined by the voltage applied to terminal 3. The switched capacitor integrator 1 operates in two phases, namely a P1 phase and a P2 phase. To drive the output of the switched capacitor integrator to a lower level, switch 5 is closed, and during the P2 phase, capacitor 7 is charged to the voltage level VP as charge flows from terminal 9 into capacitor 7.

In order to drive the output of the switched-capacitor integrator to a higher level, switch 11 is closed, and during the P2 phase, capacitor 7 is charged to the low reference voltage level VN as charge flows from capacitor 7 into terminal 13. Finally, during the P1 phase there is simple charge redistribution, where charge previously loaded onto capacitor 7 by either reference voltage VPout or VNout is transferred onto capacitor 14 via utilization of amplifier 12. As would be understood by one of reasonable skill in the art, the change in output voltage of the switched capacitor integrator 1, Vout, is simply given by the difference between the reference voltage and the common mode voltage, multiplied by the ratio of capacitors 7 and 14.

A problem occurs each time the high reference voltage VP is loaded into the switched-capacitor integrator, due to the voltage level of VP decreasing when a charge is sourced to the integrator from terminal 9. In the alternative, a problem also occurs each time the low reference voltage VN is increased by receiving a charge from the integrator, due to the voltage level of VN increasing when a charge sinks from the integrator to terminal 13. With a decrease in VP value and an increase in VN value, the reference voltages VP and VN also decrease and increase respectively, thereby causing a gain error. Typical systems that are subject to this problem include, but are not limited to, over-sampling analog-to-digital converters, digital-to-analog converters, pipeline analog-to-digital converters, algorithmic analog-to-digital converters, as well as switched capacitor filters. Therefore, there is a need in the art for a reliable reference voltage value, which will remain constant, regardless of sampling rate.

Figure 2:
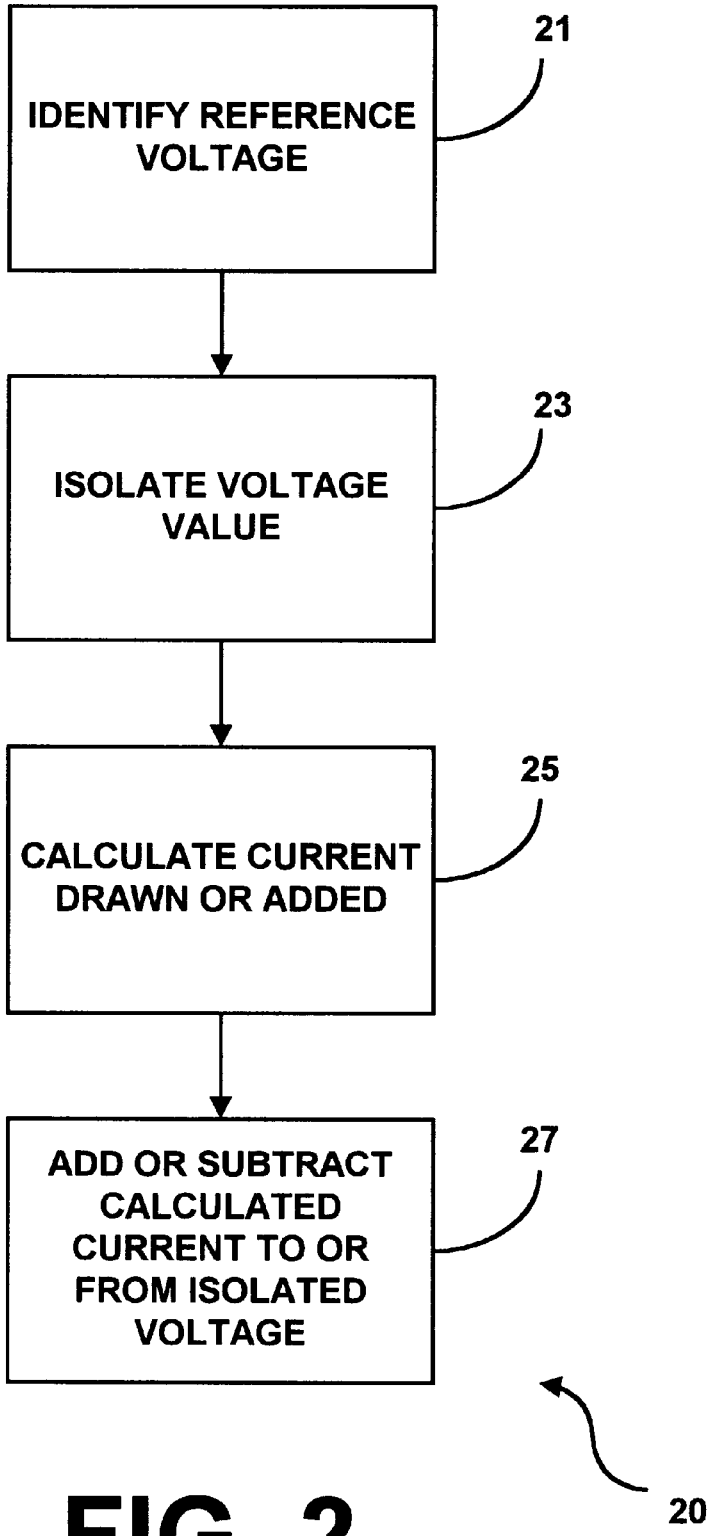
FIG. 2 is a flow chart diagram functionally representing one method of solving for varying reference voltage values in accordance with the present invention.

FIG. 2 functionally represents one method of solving for varying reference voltage values in accordance with the preferred embodiment of the invention. As represented by block 21, the value of a reference voltage is first identified. This voltage value is then isolated (block 23) and fed to the various blocks on the chip, or system, that employ this reference voltage. Examples of blocks that may employ the reference voltage include, but are not limited to, a switched capacitor filter, an analog-to-digital converter, or a continuous time analog sensing circuit.

Calculation is then performed to determine the amount of current, which has either been drawn, or added, due to sampling (block 25), from all the various blocks in operation, at whatever sampling rate they may be operating. As shown by block 27, the calculated drawn, or added, current is then either added or subtracted from the isolated voltage value, thereby obtaining the original reference voltage.

Figure 3:
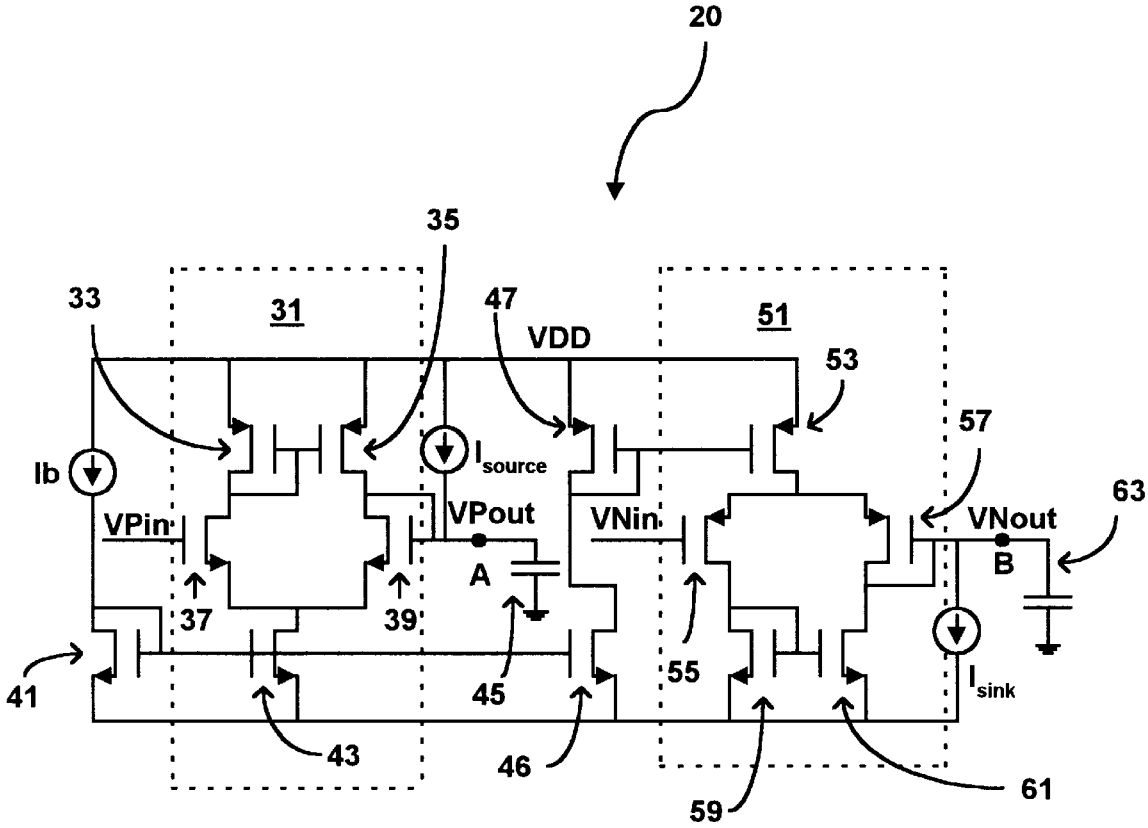
FIG. 3 is a circuit diagram of the reference voltage stabilizer of FIG. 2.

FIG. 3 illustrates one embodiment of the solution to varying reference voltage values. As a preliminary matter it should be noted that, while the preferred embodiment of the invention is described with reference to the use of transistors, alternative devices may be utilized such as, but not limited to, diodes or resistors. Referring back to FIG. 3, in accordance with the preferred embodiment of the invention, a high reference voltage, VPin, is first amplified by a first unity gain buffer amplifier 31, thereby stabilizing and isolating the voltage value of VPin, and deriving an output voltage VPout. The first unity gain buffer amplifier 31 is powered by a voltage Vdd and comprises transistors 33, 35, 37, 39 and 43. The gain and potential offset error of the first unity gain buffer amplifier 31 is defined by the transconductance of transistors 37 and 39.

A current Ib biases transistor 41, which sets up the tail current in transistor 43. Ideally, the value of VPout will equal the value of VPin. To accomplish this, a programmable source current, $I_{source}$ which is symbolic of the amount of current which is drawn out of VPout during sampling, via node A, is directly added to VPout to prevent any gain error or offset which may have occurred. Further, a capacitor 45 keeps the voltage value of VPout steady by filtering out switching noise. Assuming that the system samples the high reference voltage (Vpout) half the time, the value of $I_{source}$ may be determined by the following equation:

$$I_{source}=(VPout-VCM)C1(f_s/2), \quad \text{(Eq. 1)}$$

where C1 is the capacitance of capacitor 45 and $f_s$ is the sampling rate of the system using the reference voltage stabilizer.

In accordance with FIG. 3, transistor 41 mirrors the current Ib to transistors 43 and 46. Transistor 46, in turn, mirrors current to transistor 47 which transmits the current into a second unity gain buffer amplifier 51. In accordance with the preferred embodiment of the invention, a low reference voltage, VNin, is first amplified by the second unity gain buffer amplifier 51, thereby stabilizing the voltage value of VNin, and deriving an output voltage VNout. The second unity gain buffer amplifier 51 is powered by the voltage Vdd, as was the first unity gain buffer amplifier 31, and comprises transistors 53, 55, 57, 59 and 61. The gain and potential offset error of the second unity gain buffer amplifier 51 is defined by the transconductance of transistors 55 and 57.

Ideally, the value of VNout will equate the value of VNin. To accomplish this, a programmable sink current, $I_{sink}$, which is symbolic of the amount of current which is added to VNout during sampling, via node B, is directly subtracted from VNout to prevent any gain error or offset which may have occurred. Further, a second capacitor 63 keeps the voltage value of VNout steady by filtering out switching noise. Assuming the system samples the low reference voltage (VNout) half the time, the value of $I_{sink}$ may be determined by the following equation:

$$I_{sink}=(VCM-VNout)C2(f_s/2), \quad \text{(Eq. 2)}$$

where C2 is the capacitance of capacitor 63 and $f_s$ is the sampling rate of the system using the reference voltage stabilizer.

In an alternate embodiment of the present invention, the programmable source and sink currents may be programmed to compensate for an error in the reference voltage values which are fed into the first and second unity gain buffer amplifiers 31, 51. These reference voltages typically have some deviation from the intended reference voltages, as well as variation across processing. Among the most significant causes for reference voltage errors are bipolar device mismatches, resistor mismatches, and MOS device mismatches, each of which can significantly alter the value of the reference voltages.

The difference between two reference voltages determines the gain of sample data systems, which typically, for telecommunication applications, needs to be specified with an accuracy of 100 mdB, or better then 1%. The reference voltages are thus typically laser-trimmed, or trimmed with fuses at the wafer stage, in order to achieve this accuracy. Unfortunately, these methods increase microchip-processing cost.

In accordance with this embodiment of the invention, compensation for reference voltage error can be obtained by adding an intentional difference between the sink and source currents drawn by the sampling blocks, and the current supplied by $I_{source}$ and $I_{sink}$, to compensate for the current drawn from the reference voltages. If we add the same current into node A as we pull out of node B, the VPout voltage is effectively increased as much as the VNout voltage is decreased, assuming both unity gain buffer amplifiers 31, 51, have the same input transconductance. Therefore, correction is only performed for the difference between the two, which determines the gain of the sample data system.

Alternatively, if an interest exists in obtaining the absolute value of each reference voltage accurately, they may be controlled independently by not making the source and sink currents track and instead, tuning them separately.

It should be noted that it will be obvious to those skilled in the art that many variations and modifications may be made to the embodiments discussed herein without substantially departing from the principles of the present invention. All such variations and modifications are intended to be included herein within the scope of the present invention, as set forth in the following claims. Further, in the claims hereinafter, the corresponding structures, materials, acts, and equivalents of all means or step plus function elements are intended to include any structure, material, or acts for performing the functions in combination with either claimed elements as specifically claimed.

What is claimed is:

1. A system for stabilizing a reference voltage, independent of a sampling rate, comprising:

an amplifier; and a programmable current;

wherein said amplifier amplifies said reference voltage to a predefined voltage level, resulting in an amplified reference voltage, so as to maintain a voltage level of said reference voltage, and said programmable current modifying said amplified reference voltage to compensate for an adjustment in a current level of said reference voltage caused by a sampling of said reference voltage.

2. The system of claim 1, wherein said amplifier is a unity gain buffer amplifier.

3. The system of claim 1, wherein said reference voltage is adjusted by said programmable current to compensate for a reference voltage error before amplification, thereby deriving a correct reference voltage.

4. The system of claim 1, wherein said programmable current is further defined by a sink current and a source current.

5. The system of claim 4, wherein said sink and source currents are controlled by a single control loop.

6. The system of claim 4, wherein said sink and source currents are controlled by separate control loops.

7. The system of claim 1, wherein said reference voltage is defined by a common mode voltage (VCM), a high reference voltage (VP), and a low reference voltage (VN).

8. The system of claim 3, wherein said programmable current is determined by the equation, $I_{source}$=(VPout−VCM)C1($f_s$/2), in response to said adjustment in current being a decrease in reference voltage level, wherein VPout is said reference voltage VP, after amplification by said amplifier, C1 is the capacitance of a first capacitor which decreases sampling noise, and $f_s$ is the sampling rate of said system.

9. The system of claim 3, wherein said programmable current is determined by the equation, $I_{sink}$=(VCM−VNout) C2($f_s$/2), in response to said adjustment in current being an increase in reference voltage level, wherein VNout is said reference voltage VN, after amplification by said amplifier, C2 is the capacitance of a second capacitor which decreases sampling noise, and $f_s$ is the sampling rate of said system.

10. A method of stabilizing a reference voltage, independent of a sampling rate comprising the steps of:

amplifying said reference voltage to a predefined voltage level, resulting in an amplified reference voltage, so as to maintain a voltage level of said reference voltage; and modifying said amplified reference voltage by a current to compensate for an adjustment in a current level of said reference voltage caused by a sampling of said reference voltage.

11. The method of claim 10, wherein said amplification is performed by a unity gain buffer amplifier.

12. The method of claim 10, further comprising the step of adjusting said reference voltage by said current to compensate for a reference voltage error before said amplifying step, thereby deriving a correct reference voltage.

13. The method of claim 10, wherein said current is programmable.

14. The method of claim 10, wherein said reference voltage is defined by a common mode voltage (VCM), a high reference voltage (VP), and a low reference voltage (VN).

15. The method of claim 12, wherein said current is determined by the equation, $I_{source}$=(VPout−VCM)C1($f_s$/2), in response to said adjustment in current being an decrease in reference voltage level, wherein VPout is said reference voltage VP, after amplification by said amplifier, C1 is the capacitance of a first capacitor which decreases sampling noise, and $f_s$ is said sampling rate.

16. The method of claim 12, wherein said current is determined by the equation, $I_{sink}$=(VCM−VNout)C2($f_s$/2), in response to said adjustment in current being an increase in reference voltage level, wherein VNout is said reference voltage VN, after amplification by said amplifier, C2 is the capacitance of a second capacitor which decreases sampling noise, and $f_s$ is said sampling rate.

17. The method of claim 13, wherein said programmable current is further defined by a sink current and a source current.

18. The method of claim 17, wherein said sink and source currents are controlled by a single control loop.

19. The system of claim 17, wherein said sink and source currents are controlled by separate control loops.

20. A system for stabilizing a reference voltage, independent of a sampling rate, comprising:

an amplifier; and a programmable current;

wherein said amplifier amplifies said reference voltage, resulting in an amplified reference voltage, wherein said reference voltage is adjusted by said programmable current to compensate for a reference voltage error before amplification, thereby deriving a correct reference voltage, so as to maintain a voltage level of said reference voltage, and said programmable current modifying said amplified reference voltage to compensate for an adjustment in a current level of said reference voltage caused by a sampling of said reference voltage, and wherein said programmable current is determined by the equation, $I_{source}=(VPout-VCM)C1(f_s/2)$, in response to said adjustment in current being a decrease in reference voltage level, wherein VPout is said reference voltage VP, after amplification by said amplifier, C1 is the capacitance of a first capacitor which decreases sampling noise, and $f_s$ is the sampling rate of said system.

21. A system for stabilizing a reference voltage, independent of a sampling rate, comprising:

an amplifier; and a programmable current;

wherein said amplifier amplifies said reference voltage, resulting in an amplified reference voltage, wherein said reference voltage is adjusted by said programmable current to compensate for a reference voltage error before amplification, thereby deriving a correct reference voltage, so as to maintain a voltage level of said reference voltage, and said programmable current modifying said amplified reference voltage to compensate for an adjustment in a current level of said reference voltage caused by a sampling of said reference voltage, and wherein said programmable current is determined by the equation, $I_{sink}=(VCM-VNout)C2(f_s/2)$, in response to said adjustment in current being an increase in reference voltage level, wherein VNout is said reference voltage VN, after amplification by said amplifier, C2 is the capacitance of a second capacitor which decreases sampling noise, and $f_s$ is the sampling rate of said system.

22. A method of stabilizing a reference voltage, independent of a sampling rate comprising the steps of:

amplifying said reference voltage, resulting in an amplified reference voltage, so as to maintain a voltage level of said reference voltage;

modifying said amplified reference voltage by a current to compensate for an adjustment in a current level of said reference voltage caused by a sampling of said reference voltage; and adjusting said reference voltage by said current to compensate for a reference voltage error before said amplifying step, thereby deriving a correct reference voltage, wherein said current is determined by the equation, $I_{source}=(VPout-VCM)C1(f_s/2)$, in response to said adjustment in current being a decrease in reference voltage level, wherein VPout is said reference voltage VP, after amplification by said amplifier, C1 is the capacitance of a first capacitor which decreases sampling noise, and $f_s$ is said sampling rate.

23. A method of stabilizing a reference voltage, independent of a sampling rate comprising the steps of:

amplifying said reference voltage, resulting in an amplified reference voltage, so as to maintain a voltage level of said reference voltage; and modifying said amplified reference voltage by a current to compensate for an adjustment in a current level of said reference voltage caused by a sampling of said reference voltage; and adjusting said reference voltage by said current to compensate for a reference voltage error before said amplifying step, thereby deriving a correct reference voltage, wherein said current is determined by the equation, $I_{sink}=(VCM-VNout)C2(f_s/2)$, in response to said adjustment in current being an increase in reference voltage level, wherein VNout is said reference voltage VN, after amplification by said amplifier, C2 is the capacitance of a second capacitor which decreases sampling noise, and $f_s$ is said sampling rate.

* * * * *